US007156142B2

(12) United States Patent
Peterson

(10) Patent No.: US 7,156,142 B2
(45) Date of Patent: Jan. 2, 2007

(54) VERTICALLY MOVABLE PARTITION WALLS

(75) Inventor: Miles E. Peterson, Ontario (CA)

(73) Assignee: Railtech Ltd., Baie D'Urfe (CA)

( * ) Notice: Subject to any disclaimer, the term of this patent is extended or adjusted under 35 U.S.C. 154(b) by 142 days.

(21) Appl. No.: 10/806,883

(22) Filed: Mar. 23, 2004

(65) Prior Publication Data

US 2005/0211395 A1 Sep. 29, 2005

(51) Int. Cl.
*E06B 9/06* (2006.01)

(52) U.S. Cl. ..... 160/84.11; 160/138; 160/165

(58) Field of Classification Search ..... 160/84.11, 160/84.08, 84.09, 218, 213, 161, 138, 136, 160/137, 150, 188
See application file for complete search history.

(56) References Cited

U.S. PATENT DOCUMENTS

| | | | | |
|---|---|---|---|---|
| 231,817 | A | 8/1880 | Kerr | 160/84.09 |
| 702,146 | A | 6/1902 | McCloud | 160/147 |
| 1,892,340 | A | 12/1932 | Guth | |
| 1,965,262 | A * | 7/1934 | Sergi | 160/149 |
| 2,237,141 | A | 4/1941 | Gale | |
| 2,986,210 | A * | 5/1961 | Rosenfeld | 160/84.11 |
| 3,378,059 | A | 4/1968 | Young | |
| 5,062,464 | A | 11/1991 | Peterson | |
| 6,267,169 | B1 | 7/2001 | McDonald | |
| 6,808,000 | B1 * | 10/2004 | Peterson | 160/84.11 |

FOREIGN PATENT DOCUMENTS

| | | |
|---|---|---|
| CA | 2064348 | 5/1994 |

* cited by examiner

*Primary Examiner*—Blair M. Johnson
(74) *Attorney, Agent, or Firm*—Conley Rose P.C.

(57) ABSTRACT

A partition wall, upwardly movable into storage position and downwardly movable into vertical, down position. The wall comprises a plurality of similar trains of elongated members. The members of each train are arranged to form a single pantograph forming longitudinally aligned rows of diamonds. The trains are spaced laterally to form a wall plane and oriented so that the diamonds of the pantographs operate in a plane at a 90° angle to that wall plane. A plurality of panels are provided, each panel being secured to a pair of corresponding members in adjacent trains. The panels are secured to corresponding pairs of opposed sides of the diamonds. Means are provided to raise and lower the trains at a similar rate. The pantographs are contracted when the wall is in a storage position and the elongated when the wall is in down position. The panels form a vertical wall when the pantographs are elongated in down position.

9 Claims, 4 Drawing Sheets

VERTICALLY MOVABLE PARTITION WALLS

FIELD OF THE INVENTION

The present invention relates to partition walls and more particularly to vertically movable partition wall for use within buildings, for example to cordon off areas, as required, to prevent public access, for crowd control, or for reconfiguring usable space in a building.

BACKGROUND OF THE INVENTION

Conventional movable partition wall systems usually take the form of horizontally sliding panels, and are used for example to close or section off areas in buildings. These types of partition wall systems usually require storage space beside the area being closed off, to accommodate the panels when not in use.

U.S. Pat. No. 5,062,464 of Miles Peterson, issued Nov. 5, 1991 describes and illustrates a partition wall which uses a pantograph type of construction to provide a rigid wall section, which is vertically collapsible and movable to a storage position. Conventional horizontally movable partition wall systems have problems of efficient storage and require additional structural support requirements. The Peterson vertically movable partition wall avoids those problems by providing ceiling storage for the partition wall and a single permanent location for all of the panels so that the loads imposed on the building support structure do not vary since there is no horizontal movement of the panels. Further, this design of the wall system allows the partition to be of any width or height as it is lifted and supported at multiple points across its width.

The pantograph structure as suggested by this Peterson construction is similar to that for instance found in baby gates in which a series of elongated members are pivotally linked together in spaced fashion to provide a series of similar diamonds along the length of the gate. In a single (as opposed to multiple) pantograph construction, a pair of members of similar size are pivotally linked at their midpoints. One pair of their ends are pivotally linked to the ends of a further corresponding pair of members of similar length similarly pivoted at their midpoint, and so on. The midpoints of the members are longitudinally aligned and form opposed longitudinal apexes of diamond shapes; the other opposed corners of these diamonds are formed by the pivotally secured ends of adjacent pairs of intersecting members, and are the lateral apexes. The pantograph structure expands and contracts longitudinally. The pantograph structure in such applications is useful because it causes forces applied longitudinally, in the direction of expansion and contraction of the pantograph, to be transmitted evenly throughout all of the members of the pantograph structure. As well, all of the apexes of the diamonds formed by the points of intersection of the members, as the structure is contracted, will arrive at their final, fully contracted position at the same time, meaning that the longitudinal apexes of the diamonds at one end of the pantograph structure, which are moving towards the other end during contraction, will move at a much greater speed than the apexes of the diamonds at the other end.

It is an object of the present invention to provide a movable partition wall which is based on these pantograph principles.

SUMMARY OF THE INVENTION

In accordance with the present invention there is provided a partition wall, upwardly movable into storage position and downwardly movable into vertical, down position. The wall comprises a plurality of similar trains of elongated members. The members of each train are arranged to form a single pantograph forming longitudinally aligned rows of diamonds. The trains are spaced laterally to form a wall plane and oriented so that the diamonds of the pantographs operate in a plane at a 90° angle to that wall plane. A plurality of panels are provided, each panel being secured to a pair of corresponding members in adjacent trains. The panels are secured to corresponding pairs of opposed sides of the diamonds. Means are provided to raise and lower the trains at a similar rate. The pantographs are contracted when the wall is in a storage position and elongated when the wall is in down position. The panels form a vertical wall when the pantographs are elongated in down position.

In a preferred embodiment of the present invention, similar pairs of elongated members intersect and are secured pivotally together at a central point between their ends, that point being on a longitudinal center line of each member, to form adjoining, longitudinally disposed apexes of adjacent diamonds. Ends of these pairs of intersecting members are pivotally connected to the ends of similar pairs of intersecting members at points which are laterally offset to the outside of that center line, to form at these ends laterally disposed apexes of the diamonds, so that when the trains are contracted the longitudinal apexes of each diamond are drawn together and the laterally disposed apexes are more separated, and when the trains are elongated the longitudinal apexes of each diamond become more separated and the laterally disposed apexes are drawn together. Also, in each train, similar pairs of elongated members make up one pair of opposed sides of diamonds and are spaced about similar single members making up the other opposed pair of sides of the diamonds. The panels are secured only to the spaced pairs of elongated members along the length of the train.

The partition wall according to the present invention has many advantages. Because its components move vertically rather than horizontally, storage space is not required to the side of the area within which the wall operates, since the wall folds up into and stores in a space above the area in question. Furthermore, because the wall does not move horizontally, the loads imposed on the support structure are constant. As well, it provides a relatively simple and economical construction for a partition wall.

BRIEF DESCRIPTION OF THE DRAWINGS

These and other advantages of the invention will become apparent upon reading the following detailed description and upon referring to the drawings in which.

Figure 1:
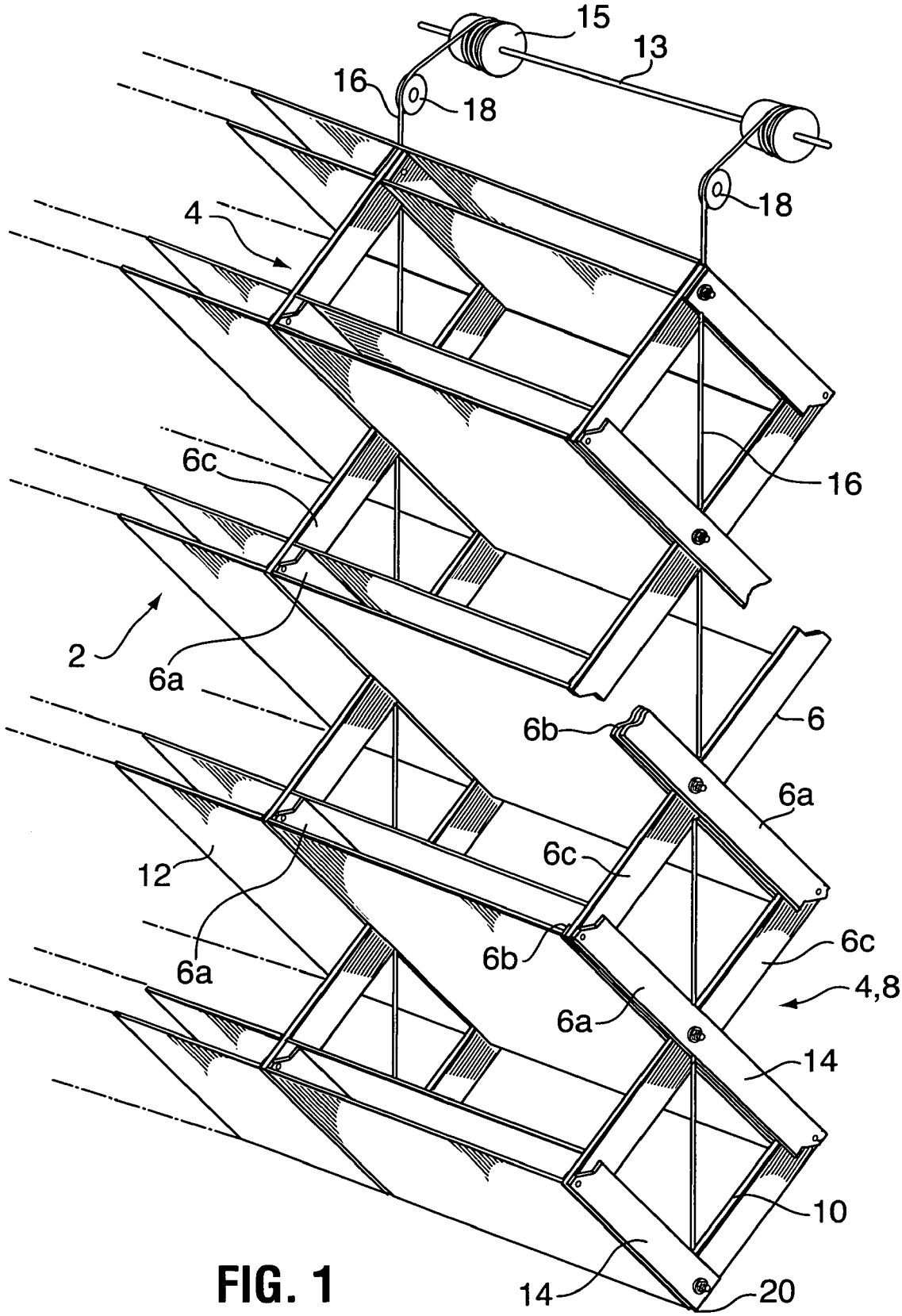
FIG. 1 is a perspective view of a portion of a partition wall according to the present invention, partially broken away, the wall being in an intermediate position between storage and down positions.

While the invention will be described in conjunction with illustrated embodiments, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Figure 2:
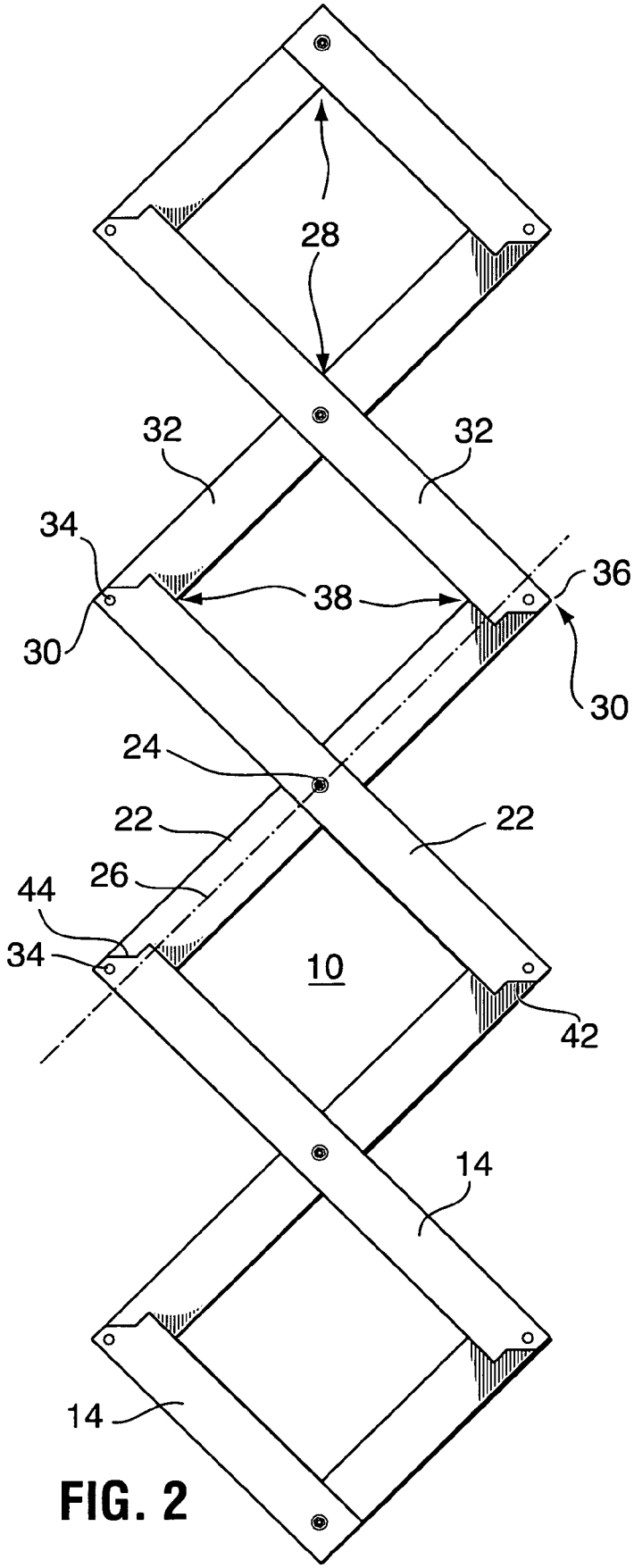
FIG. 2 is an end view of the wall of FIG. 1.
Figure 3:
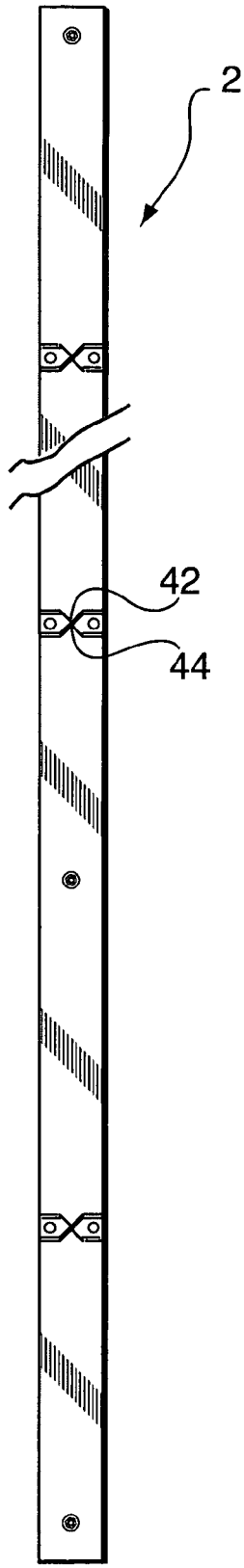
FIG. 3 is an end view of the wall of FIG. 1 showing the members and panels in down position.
Figure 5:
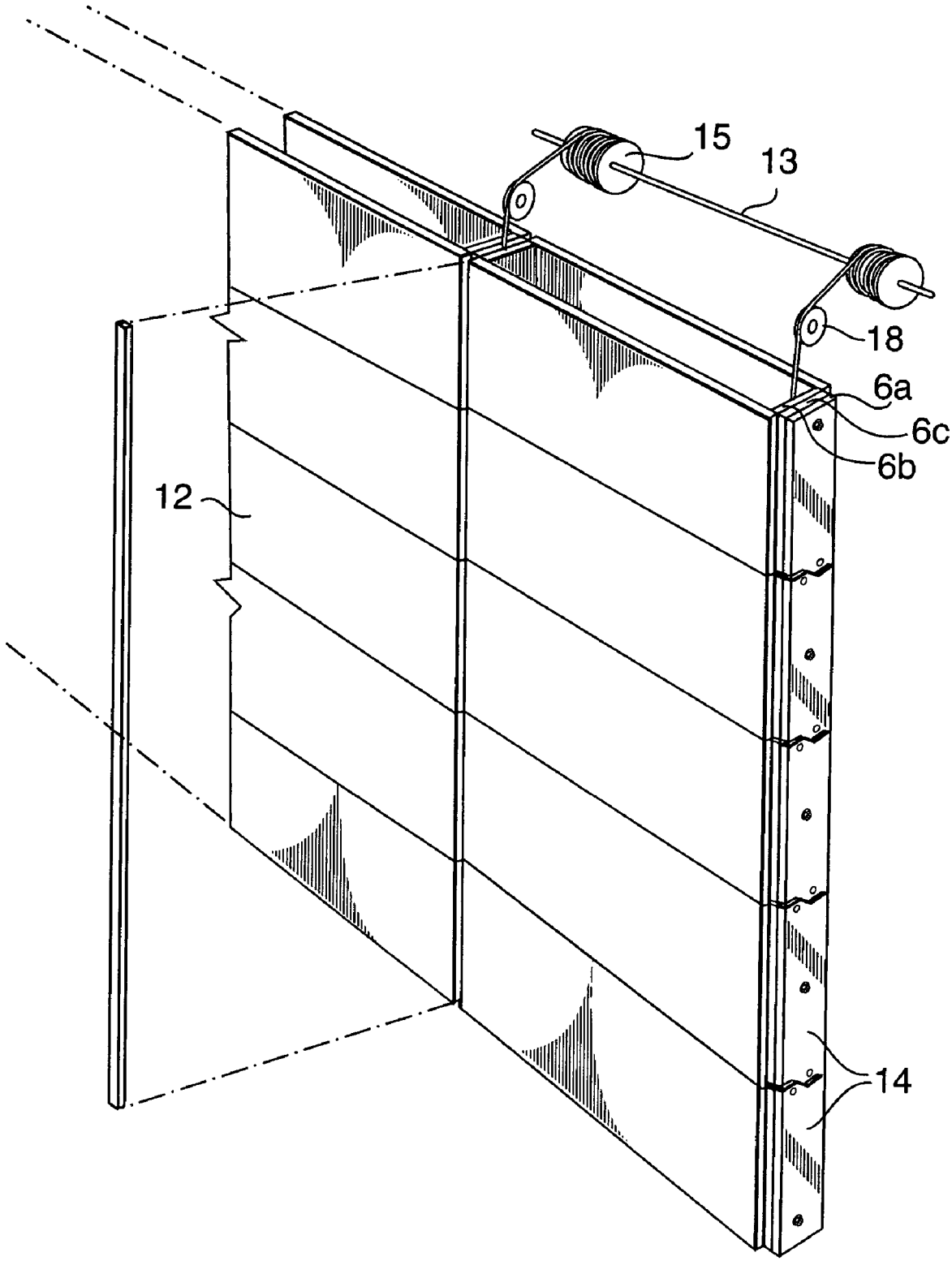
FIG. 5 is a perspective view of a portion of the partition wall in down position.

Turning to FIG. 1, there is illustrated a partition wall 2 in accordance with the present invention in an intermediate position between an upper, storage position and a down position where the wall is in vertical orientation (FIGS. 3 and 5). As can be seen in FIGS. 1 and 2, a plurality of similar trains 4 of elongated members 6 are provided, the members 6 of each train 4 arranged to form a single pantograph 8 forming longitudinally aligned rows of diamonds 10 (FIG. 2). While two trains have been illustrated in FIG. 1, any number of trains may be spaced laterally to form a wall of appropriate width. These trains lie in the vertical plane of the wall and are oriented so that the diamonds 10 of the pantographs lie and operate in a plane at a 90° angle to that wall plane.

A plurality of panels 12 are provided, secured to members 6 as will be discussed in more detail hereinafter. Each panel 12 is secured to a pair of corresponding members 6 in adjacent trains, as illustrated. The panels are secured to corresponding pairs 14 of opposed sides of the diamonds.

Figure 4:
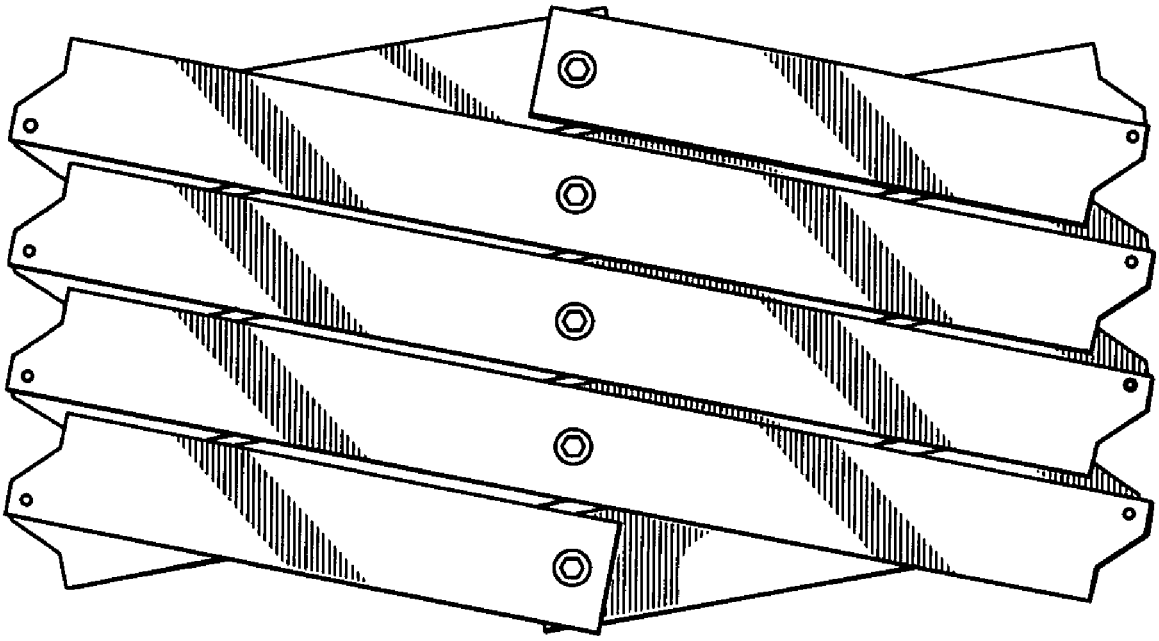
FIG. 4 is an end view of the wall of FIG. 3 showing the members and panels in storage position.

An appropriate means to move the wall panels 12 into storage position (FIG. 4) or into down position (FIG. 3) is provided in the form of a power driven line shaft 13 to which drums 15 are secured. One end of each of cables 16 is wrapped around a corresponding drum 15. Each cable 16 passes over a corresponding sheave or pulley 18 and its other end is for example operatively connected to a lower end 20 of its associated train 4, as illustrated, or to a bar (not illustrated) extending between adjacent trains 4 at their lower ends 20.

As can be seen in FIG. 2, similar pairs 22 of elongated members 6 intersect and are secured pivotally together at a central point 24 between their ends. This point is on a longitudinal center line 26 of each member. In this manner, adjoining, longitudinally disposed apexes 28 of adjacent diamonds are formed. Corresponding ends 30 of these pairs 22 of intersecting members 4 are pivotally connected to the ends 30 of similar pairs of intersecting members 32 at points 34 and 36 respectively, which points are laterally offset to the outside of center lines 26, to form, at these ends, laterally disposed apexes 38 of the diamonds 10, so that, when the trains 4 are contracted, the longitudinal apexes of each diamond 10 are drawn together and the laterally disposed apexes 38 are more separated, and when the trains 4 are elongated, the longitudinal apexes 28 of each diamond 10 become more separated and the laterally disposed apexes 38 are drawn together.

In each of the trains 4, similar pairs 6*a* and 6*b* (FIG. 1) of elongated members, making up one pair of opposed sides of diamonds 10, are spaced about similar single members 6*c*, which members make up the other opposed pair of opposite sides of the diamonds. The panels 12 are secured only to members of the spaced pairs of elongated members 6*a* and 6*b*, along the length of the train. They are not directly secured to single members 6*c*.

As can be seen in FIG. 1, each panel 12 is secured to one of the pairs of parallel elongated members making up one pair of opposed sides of diamonds in one train 4, say member 6*a*, and confronting member 6*b* from the adjacent similar pair of parallel elongated members in the adjacent train 4. In other words, members 6*a* and 6*b* in this context are in separate, but adjacent, trains 4. With this manner of connecting the panels 12 to the members 6, the panels 12 do not interfere with the operation of single members 6*c*, or vice versa, when the pantographs are moved between contracted (storage) and down positions.

The partition wall construction according to the aspect of the present invention permits pairs of panels to be secured, in spaced fashion, as illustrated in FIG. 1, to these confronting, elongated members 6*a* and 6*b*. The dead air space in the space between these panels provides heat or sound insulation. Alternatively, that space may be filled, for example, with insulation or other material (not shown).

Again, as can be seen in FIGS. 2 and 3, the use of pivot points 34 and 36 which are laterally offset to the outside of center line 26 of pairs of intersecting members for their laterally disposed apexes, and the forming of flushly mating ends 42 and 44 of these intersecting members 32, as illustrated, permits the elongated members 6 of the trains to reach a perfectly aligned orientation, as illustrated in FIGS. 3 and 5, when the trains are in down position. This feature enables the panels to align themselves, flushly in vertical orientation to form a unitary or unbroken vertical wall, or a wall having desired features, depending upon the features of the panels provided, when the partition wall is in this down position. As can be seen in FIG. 5, when in this position, only small spaces exist horizontally between the panels and somewhat wider, but still narrow vertical spaces exist between the panels.

It will be understood that the panels may be made of any suitable material, for example, metal, plastic or composite material. Some of the panels may be of transparent material, and applied so as to provide a completely transparent wall or a wall with window sections in it.

The wall may be as wide as desired, by adding appropriate numbers of similar trains 4 of elongated members 6, and associated panels 12 in adjacent fashion.

The partition wall construction according to the present invention is both simple and economical to construct and easy to operate.

Thus, it is apparent that there has been provided in accordance with the invention a partition wall that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A partition wall, upwardly movable into storage position and downwardly movable into vertical, down position, the partition wall comprising:

a) a plurality of trains of elongated members, the members of each train arranged to form a single pantograph forming longitudinally aligned rows of diamonds, the trains spaced laterally to form a wall plane and oriented so that the diamonds of the pantographs operate in a plane at a 90° angle to that wall plane;

b) a plurality of panels, each panel secured to a pair of confronting members in adjacent trains, the panels secured to corresponding pairs of opposed sides of the diamonds; and c) means to raise and lower the trains at a substantially equal rate, the pantographs being contracted when the wall is in storage position and the pantographs being elongated when the wall is in down position; the panels aligning flushly to form a vertical wall having front and rear planar surfaces when the pantographs are elongated and the wall is in the down position, the similarly located members in adjacent trains being in end-to-end vertical alignment when the wall is in the dwon position.

2. A wall according to claim 1, wherein pairs of elongated members intersect and are secured pivotally together at a central point between their ends, which point is on a longitudinal center line of each member, to form adjoining, longitudinally disposed apexes of adjacent diamonds, and the ends of each pair of intersecting members are pivotally connected to the ends of other pairs of intersecting members at points which are laterally offset to the outside of that center line, to form at these ends laterally disposed apexes of the diamonds, so that when the trains are contracted the longitudinal apexes of each diamond are drawn together and the laterally disposed apexes are more separated, and when the trains are elongated the longitudinal apexes of each diamond become more separated and the laterally disposed apexes are drawn together.

3. A wall according to claim 2, wherein in each train, pairs of parallel elongated members, making up one pair of opposed sides of diamonds, are spaced about single members making up the other opposed pair of opposed sides of diamonds, the panels being secured only to members of the spaced pairs of elongated members along the length of the train.

4. A wall according to claim 3, wherein each panel is secured to adjacent elongated members of the spaced pairs of members in adjacent trains.

5. A wall according to claim 1, wherein the means to raise and lower the trains comprises a cable means secured to the train, and means to manipulate the cable means so as to simultaneously raise or lower the trains at a similar rate.

6. A wall according to claim 5, wherein the cable means comprises a plurality of cables, each of the cables secured to a different one of the lower ends of each of the trains, portions of the cables wound about a power driven line shaft so that rotation of the line shaft in one direction, winding up the cables, causes the trains simultaneously and at a similar rate to move to contracted position and rotation of the line shaft in the other direction, unwinding the cables, and causes the trains simultaneously and at a similar rate to move to down position.

7. A wall according to claim 1, wherein spaced pairs of panels are secured to pairs of confronting members in adjacent trains.

8. A wall according to claim 4, wherein a pair of panels are secured to in spaced fashion, and extend between, adjacent ones of the elongated members in the spaced pair of members in adjacent trains so as to provide a double wall having a dead space therein when the trains are in down position.

9. A wall according to claim 1, wherein no part of the wall extends below the lowest panel when the trains are in the storage position, such that when the trains are in the storage position the space to be occupied by the wall when it is in its down position is empty.

* * * * *